US006453536B1

(12) United States Patent
Müller et al.

(10) Patent No.: US 6,453,536 B1
(45) Date of Patent: Sep. 24, 2002

(54) METHOD FOR PRODUCING HOLLOW NICKEL TITANIUM PROFILES

(75) Inventors: Klaus Müller, Berlin; Hans Nusskern, Pforzheim, both of (DE)

(73) Assignee: G. Rau GmbH & Co., Pforzheim (DE)

( * ) Notice: Subject to any disclaimer, the term of this patent is extended or adjusted under 35 U.S.C. 154(b) by 0 days.

(21) Appl. No.: 09/530,661

(22) PCT Filed: Oct. 29, 1998

(86) PCT No.: PCT/DE98/03262

§ 371 (c)(1),
(2), (4) Date: Apr. 28, 2000

(87) PCT Pub. No.: WO99/22886

PCT Pub. Date: May 14, 1999

(30) Foreign Application Priority Data

Oct. 31, 1997 (DE) ..... 197 48 125

(51) Int. Cl.[7] ..... B23P 17/00
(52) U.S. Cl. ..... 29/423; 72/368; 72/370.25
(58) Field of Search ..... 29/423, DIG. 11, 29/DIG. 47; 72/367.1, 368, 370.14, 370.25, 253.1

(56) References Cited

FOREIGN PATENT DOCUMENTS

| | | |
|---|---|---|
| EP | 0459909 B1 | 5/1991 |
| FR | 1197081 | 1/1958 |
| WO | WO 95/31298 | 11/1995 |
| WO | WO 96/17698 | 6/1996 |

OTHER PUBLICATIONS

T.W. Duerig and A.R. Pelton, Ti–Ni Shape Memory Alloys, Materials Properties Handbook 1994.
T.W. Duerig, A.R. Pelton and D. Stockel, The Use of Superelasticity in Medicine, 1996.
D. Stoekel, The Shape Memory Effect, undated.

*Primary Examiner*—David P. Bryant
(74) *Attorney, Agent, or Firm*—Ira J. Schaefer; Daniel Basov; Chadbourne & Parke LLP

(57) ABSTRACT

The invention relates to a method for producing hollow nickel titanium profiles with a small external diameter and/or small wall thickness by means of deformation, especially extrusion. According to the inventive method, a composite block is formed, comprising a solid core and one or several hollow blocks surrounding said core. The core and the hollow blocks are made of nickel titanium. The parts of the composite block are separated after deformation to obtain a wire (3*a*), a tube (1*a*) with a small diameter and a tube (5*a*) with a larger diameter.

18 Claims, 6 Drawing Sheets

METHOD FOR PRODUCING HOLLOW NICKEL TITANIUM PROFILES

The invention concerns a method of producing hollow profiles, in particular tubes, having a small external diameter and/or small wall thickness, made from a nickel titanium alloy by shaping a composite block.

Alloys having approximately the same amount of titanium and nickel atoms exhibit special effects leading to their designation as shape memory alloys. The effects are based on a thermoelastic martensitic phase change, i.e. a temperature-dependent change in the crystal structure: at high temperatures the alloy is austenitic; at low temperatures it is, however, martensitic. According to T. W. Duerig and H. R. Pelton ("TI-NI Shape Memory Alloys", in: Materials Properties Handbook: Titanium Alloys, 1994, pages 1035–1048, ASM International 1994), shape memory alloys have two properties which should be distinguished from another. Alloys with a titanium content between 49.7 and 50.7 atom % have a thermal shape memory, also called shape memory, and alloys with a titanium content of 49.0 to 49.4 atom % have a mechanical shape memory, also called super-elasticity.

In addition to binary nickel titanium alloys, other alloys can also have these properties. A shape memory alloy can contain ternary components (e.g. iron, chrome or aluminium). The ratio between nickel and titanium and the presence of ternary additions strongly influence the markedness of the thermal and mechanical shape memory. Even slight concentration variations cause large changes in the material properties.

When using thermal shape memory for building components, an alloy of suitable composition is transformed, without diffusion, from an austenitic to a martensitic structure by cooling. Subsequent shaping of a component produced from this alloy can be reversed by thermal treatment thereof (heating to temperatures above a certain transition temperature). The original austenitic structure is thereby reproduced and the component adapts to its original shape. The transition temperature is usually the temperature at which the martensite is completely changed to an austenite. The transition temperature depends largely on the composition of the alloy and the loading of the component. Components having a thermal shape memory can cause movements and/or exert forces.

The mechanical shape memory effect occurs in a component made from a suitable alloy of austenitic structure when the construction unit is shaped within a certain temperature range. It is thereby energetically more favorable for the austenitic structure to change into a martensitic structure when loaded, wherein elastic expansions of up to 10 percent can be achieved.

Upon load relief, the structure returns to the austenitic phase. Components made from such an alloy can therefore store shaping energy.

Conventional alloys having the above-described properties are designated as Nickel Titanium, Titanium Nickel, Teenee, Memorite®, Nitinol, Tinel®, Flexon® and Shape-Memory-Alloys. These terms do not refer to one single alloy of a certain composition, but to a family of alloys having the described properties.

Many technical fields, e.g. medical technology and mechanics, are highly interested in use of components made from shape memory compositions due to the particular properties of nickel titanium alloys. In mechanical applications, they can e.g. be used for switching elements, actuating elements or valves. Shape memory alloys are also used to an increasing degree in medical technology, since components made from such alloys are biologically acceptable, fatigue-resistant and have also good flexibility as superelastic alloys.

Stents, catheters and endoscopic and laparoscopic instruments for minimum-invasive diagnosis and therapy are examples for use of nickel titanium alloys in medical technology, the intermediate product being a nickel titanium tube. Intermediate products in the form of tubes, in particular, of small external diameter, are also required for other applications.

Large-scale use of nickel titanium tubes and instruments is curtailed inter alia by the currently high price thereof which, in turn, results from the conventional methods for producing the tubular intermediate product.

Conventionally, nickel titanium tubes are produced by drilling forged bars. The tubes typically have an external diameter of between 12 and 25 mm. Due to the poor cutting property of nickel titanium alloys, the deep hole drilling method is difficult and results in short service life for the tools, long processing times and high production costs for the tubes. In addition, there is large material loss, in particular, when producing thin-walled tubes. The cuttings produced during drilling or turning on the lathe are waste material.

European patent document 0459909 describes manufacture of seamless tube from a corrosion-resistant alloy, consisting almost exclusively of titanium, using a tube extrusion method. In the method, a perforated press block is pressed through a gap between a press mandrel and a die using punch pressure. After subsequent shaping, the tubes generated in this manner serve e.g. for heating salt water in sea water desalination plants and as heat exchanger tubes in chemical production plants.

Due to the unfavorable shaping behavior of nickel titanium alloys, only tubes with a large external diameter (more than 40 mm) can be extruded economically using such a method. The extrusion of tubes having a smaller diameter is expensive since, due to the lack of cooling, it is not possible to achieve a sufficiently long tool service life in the temperature range dictated by the material. Moreover, the mandrels break off easily during extrusion, leading to a large amount of waste. The very large formation resistance of nickel titanium alloys at very high formation temperatures prevents production of small, thin tubes, since the press mandrel cannot withstand the high thermal and mechanical tensile loads which occur. According to prior art, therefore tubes having a large external diameter are initially prefabricated by tube extrusion and subsequently shaped into tubes of the desired small diameter using additional expending processing steps, e.g. drawing and rolling. Due to the advantages of nickel titanium alloys, in particular of shape memory alloys, these disadvantageous costs associated with the demanding production procedures are accepted in prior art.

WO 96/17698 discloses a method for lost core extruding of composite blocks without using a press mandrel. A block hollowed-out by drilling is filled with a steel core and both are extruded once together. The geometrical shape of the hollow extruded product depends on the geometrical shape of the extrusion die and of the core. The larger the core relative to the extrusion die, the thinner the wall. When thin-walled tubes are produced, this type of block preparation therefore results in considerable material waste, which is a substantial disadvantage with nickel titanium alloys. Moreover, in this method, the shaping process disadvantageously results in the metal core forming an intimate metallic connection with the nickel titanium material in the extruded product such that an additional processing step is required to remove the core material for obtaining a hollow extruded product, e.g. by drilling out and/or chemically removing the core material. Moreover, a desired small profile dimension cannot be achieved in all cases in a single extrusion of the composite block.

It is the underlying purpose of the invention to provide a method for the production of hollow profiles or tubes made from a nickel titanium alloy having a small external diameter and/or a small wall thickness in an inexpensive and effective manner. The hollow profiles or tubes may have any cross-sectional shape. The designation tube therefore refers to any profiled tube or hollow profile.

This object is achieved with a method for producing hollow profiles, made from a nickel titanium alloy, having small external diameters and/or small wall thickness through shaping of a composite block, wherein, in a first step, a composite block is formed comprising a solid core of a nickel titanium alloy, a first hollow block of a nickel titanium alloy surrounding the core, and a separating layer disposed between the first hollow block and the core. In a second step, the composite block is shaped by a formation method. In a third step, the first hollow block shaped into a first hollow profile and the shaped core are separated out from the shaped composite block.

The invention simplifies production effort and reduces nickel titanium waste by stabilizing the hollow block with a core during shaping, wherein the shaped core itself, with regard to its material as well as its shape, is suitable for further use. In accordance with the invention, the core is made from a nickel titanium alloy. The core, shaped into a solid full profile, can e.g. subsequently be used as wire or as an intermediate product in further processing steps. This reduces waste of the expensive initial material used in production.

In the method in accordance with the invention, an initial nickel titanium material is therefore divided into zones and the intermediate spaces are filled with a separating layer, e.g. a non-metal powder material, which does not bind to nickel titanium. The dimensions of the shaped products depend on the geometrical shape and the zone division in the composite block and on the formation method selected. The number and diameter of the individual zones can thereby be varied and depend on the shaped products desired.

The material forming the separating layer prevents contact among the individual zones before, during and after formation of the composite block to facilitate easy separation of the individual constituents of the shaped composite block from one another after shaping.

The shaping method can be varied. In a first advantageous embodiment, the composite block is extruded. The composite block is a heated up press block disposed in a block recepticle of a press and is extruded through a die opening by the pressure of a punch. The hollow block which is to be extruded into a tube is thereby stabilized during extrusion with a core inserted therein. The core can be removed after extrusion. In this respect, the method in accordance with the invention is analogous to one step of a multiple composite extrusion method. However, in contrast to the conventional, multiply repetitive composite extrusion, single extrusion may be sufficient. In addition, the obtained composite extrusion components are separated after extrusion to obtain a tube.

In contrast to tube extrusion, the method in accordance with the invention permits lower pressure extrusion operation which reduces wear of the pressing tools. Due to the small external diameter of the tube produced in accordance with the invention, optional subsequent shaping operations, e.g. cold-drawing, can be initiated with a smaller external diameter to save processing steps.

In a different advantageous embodiment of a shaping method, the composite block is formed by a warm-drawing, cold-drawing, rolling, round-hammering or pilger method.

In accordance with the invention, the tube is stabilized by the core during shaping. Within the scope of the invention, tubes can thereby be produced having a small external diameter and/or small wall thickness in an effective and inexpensive manner, despite the unfavorable shaping behavior of nickel titanium alloys having, in general, maximum shaping ratios during extrusion of 20:1.

The invention proposes various ways of producing the original composite block to be formed. In a first advantageous variant, the core is inserted into the first hollow block, in particular into a hollow profile, and preferably into a tube. Within the scope of the invention, a tube is a tube-shaped hollow block. Here, and also in other variants in accordance with the invention, it may be advantageous to form the composite block with one or more additional hollow blocks arranged around the first hollow block with a separating layer between each of the neighboring hollow blocks, wherein the composite block, comprising the several hollow blocks and the core, is shaped in the second step. This is particularly advantageous for producing several thin-walled hollow profiles in one formation step.

Moreover, it can be advantageous to form the composite block by inserting several hollow blocks, in particular hollow profiles, preferably tubes, into one another. In this respect, the previous and subsequent description equally applies to hollow blocks, hollow profiles, and tubes.

The hole in the hollow block for insertion of the core can be drilled or milled into a block or through a block. Since this always entails loss of material, even if the hole, except for the separating gap, is filled with a solid profile, an advantageous feature of the invention suggests forming the composite block, a hollow block or the core using cavity sink EDM or wire EDM in a solid nickel titanium block, a hollow nickel titanium block, or another nickel titanium workpiece.

It has been surprisingly shown within the scope of the invention, that electrical discharge machining, in particular using cavity sink EDM or wire EDM, facilitates advantageous processing of nickel titanium workpieces, especially when a part, in particular a solid core or a hollow profile, is taken out or separated from a block. Use of a tube-shaped electrode made from copper or from a copper alloy is preferred.

The method in accordance with the invention is directed towards the production of tubes made from a nickel titanium alloy, in particular a shape memory alloy as described above. The alloys used may be binary or may also contain ternary additives. The method serves preferably for producing tubes made from a nickel titanium alloy having super-elastic properties. The core, shaped into a solid full profile, also preferably has super-elastic properties.

With extrusion, the external diameter of the extruded composite block and therefore of the outer tube depends on the diameter of the opening in the die which cannot be arbitrarily small. The smaller the opening, the larger the pressure which must be used for extrusion and the shorter the service life of the pressing tools. In a preferred embodiment, the shaped composite block is inserted, before removal of the narrowed core, into a second hole fashioned in an additional hollow block made from a nickel titanium alloy to produce tubes of smaller external diameter. A multiple composite block is thereby made comprising the additional perforated hollow block and the first shaped composite block with the narrowed core, wherein the second composite block formed in this manner, comprises a separating layer between the first composite block, serving as a core, and the second composite block. A multiple composite bar is then extruded from the multiple composite block to thereby reduce the diameter of the additional perforated hollow block, the first hollow block and the core. This procedure can also be applied to composite blocks having several layers and to other shaping methods.

The shaped multiple composite block comprises a second tube formed from the second narrowed hollow block, the first additional narrowed tube and the additional narrowed core. After formation, the tubes are separated and the narrowed core removed. This two-step shaping process, e.g. extrusion, permits use of a larger die opening which is advantageous with regard to the required pressing power and the service life of the pressing tools. After separation of the tubes and removal of the core, two extruded tubes of different diameters are available for further processing.

If even smaller dimensions are desired, in particular for the innermost, smallest tube, formation or extrusion can be advantageously repeated once or a plurality of times until a predetermined external diameter for the smallest tube is achieved. Towards this end, the formed multiple composite block is inserted into another hole fashioned in an additional hollow block before the tubes are separated and the core removed, and the multiple composite block thereby formed is shaped to produce another tube. Insertion and shaping can be repeated, wherein an additional tube is made in each formation step. When this multiple step shaping or extrusion (multiple composite extrusion) is completed, all of the formed tubes are separated and the narrowed core is removed.

When the method in accordance with the invention is repeated once or a plurality of times, the once or repetitively narrowed core can also be removed along with the first innermost tube of the narrowed block (optionally together with one or more additional tubes neighboring the first tube), to subsequently insert a different core of nickel titanium or another material into the remaining block, which, in turn, can then be further reduced, i.e. either in its present form or after insertion into a further hollow block. Tubes with a uniform, small diameter can thereby be produced, wherein less tubes of larger diameter result.

Before formation, one hole is fashioned in each block or in each of the required hollow blocks, having e.g. a diameter between 10 mm and 60 mm, preferably between 20 mm and 40 mm. The hole is preferably eroded but can also be produced in the material in a different manner. In comparison to a blind hole, a through-hole has the advantage that, during formation, in particular extrusion, no solid piece, i.e. a section of the extruded bar without core, is generated which must initially be separated to produce a tube and which represents waste material.

In a preferred variant of the method, the composite block is shaped to a diameter which corresponds essentially to the diameter of the first hole of the core prior to formation. In this manner, the shaped composite block can be inserted into an additional hollow block having the same core diameter as the previous hollow block for forming a multiple composite block.

Advantageously, the multiple composite block can be shaped to a diameter corresponding essentially to the diameter of the composite block, serving as a core, before formation. In this way, the shaped multiple composite block can be inserted into a further hollow block having the same core diameter for forming a further multiple composite block.

The required diameter of the shaped composite block or multiple composite block is effected by appropriate dimensioning of the shaping tools. These method variants have the advantage that holes of uniform diameter can be formed in the required hollow blocks to reduce block preparation requirements.

In an advantageous manner, the external diameter of the first hollow block or tube after the first shaping step is less than 40 mm, preferably less than 25 mm. The smaller the external diameter of the produced tube or tubes, the larger the cost reduction for subsequent shaping operations. The wall thickness of a thin-walled tube is generally between 2% and 10% of the external diameter.

The invention is explained in more detail below by means of the embodiments, schematically illustrated in the drawings.

Figure 1:
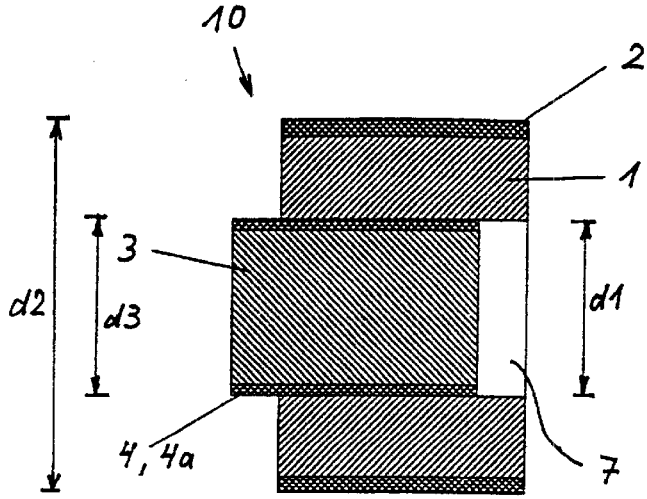
FIG. 1 shows a longitudinal section through a composite block.

The first hollow block 1 of FIG. 1 is made, e.g. forged, from a shape memory alloy with super-elastic properties. A first through-hole 7 is produced, e.g. drilled, in the first hollow block 1, the block 1 having a diameter d2 of approximately 100 mm. The diameter d1 of the first hole 7 is approximately 30 mm.

To improve the flow behavior and to reduce tool wear during formation, e.g. extrusion, a sliding layer 2 of a friction-reducing material is applied to the surface of the first hollow block 1 before formation. In the embodiment shown, the sliding layer 2 comprises copper and was applied by inserting the first hollow block 1 into a copper tube having a corresponding diameter. A copper layer can e.g. also be applied by plasma jet or flame spraying.

The sliding layer 2 can also be made from glass or another material. In comparison to the glass sliding layer frequently used for extrusion, copper has the advantage that it can also serve as a sliding layer in a subsequent cold formation process, e.g. drawing. A glass sliding layer, however, must be previously removed in order to protect the shaping tools. The sliding layer 2 can also comprise other materials, in particular graphite applied in the form of a paste, or a ceramic substance applied in the form of sludge.

The total diameter d2 of the first hollow block 1, including the applied sliding layer 2 (referred to below as the press block diameter), is approximately 110 mm in the embodiment shown. A sliding layer 2 could be omitted if the formation tools (e.g. for extrusion) are made from a material which does not tend to weld with the nickel titanium alloy or if a formation method is selected which does not cause welding.

A core 3 is inserted into the first hole 7 of the first hollow block 1 to form a composite block 10, the diameter d3 of which, including a separating layer 4 applied thereon (in the following referred to as the core diameter), corresponds essentially to the diameter d1 of the first hole 7. The core 3 also comprises a nickel titanium alloy. For this reason, it has the same flow behavior during extrusion as the first hollow block 1. Thereby, in accordance with an advantageous further development, an alloy composition is selected for the core 3 having a higher martensite-austenite transition temperature than the alloy of the first hollow block 1. This is advantageous for removal of the core 3 after formation, as described below.

The core 3 stabilizes the first hollow block 1 during formation into a first tube. Moreover, it defines the internal diameter of the first tube, since its diameter is also reduced during extrusion. For this reason, the core 3 advantageously comprises a material which has similar or identical flow behavior during formation, as the alloy of the first hollow block 1. In this manner, the composite block diameter d2 and the core diameter d3 are uniformly reduced during formation, i.e. the relationship between cross-sectional surface of the first hollow block 1, including the sliding layer 2, and the cross-sectional surface of the core 3, including separating layer 4, remains essentially the same before and after formation. This allows calculation of the external and internal diameters of the resulting tube for predetermined initial conditions (in particular composite block diameter d2, core diameter d3, diameter of the die opening during extrusion).

If the resulting tube has relatively thin walls, i.e. if the cross-sectional surface relationship between tube and core 3 is small, it can be advantageous to also fashion the core 3 from a super-elastic alloy.

In an alternative embodiment, in particular for repeated formation with a replaced core, the core 3 can comprise a copper chrome alloy. This has a flow behavior similar to that of the nickel titanium alloy in the first hollow block 1.

A temperature-resistant separating layer 4 of copper is applied on the core 3 in order to prevent unreleasable connection between the core 3 and the first hollow block 1 during formation. It can also contain other materials, in particular graphite, talcum, a mixture of talcum or a ceramic substance like e.g. aluminium oxide, magnesium oxide or titanium oxide. The separating layer 4 prevents diffusion of atoms between the core 3 and first press block 1 during extrusion.

Figure 2:
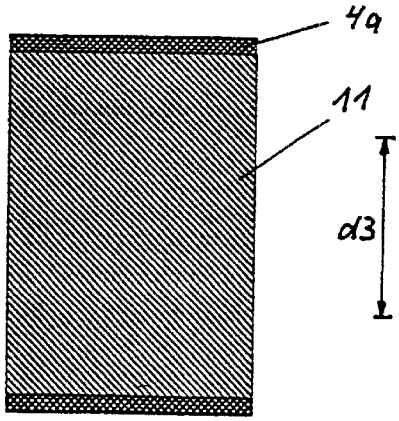
FIG. 2 shows a longitudinal section through a core press block.
Figure 3:
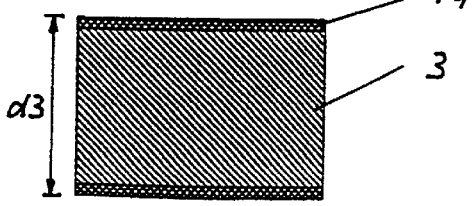
FIG. 3 shows a longitudinal section through a core.

In a method variant, a core 3 is produced by a formation method. To produce the core 3, a sliding layer 4*a* of copper is applied to a solid core press block 11 of a shape memory alloy, shown in FIG. 2. The core press block 11 is shaped using a conventional formation method, e.g. extrusion. The extruded product is cut to length to form the actual core 3 (FIG. 3). The sliding layer 4*a* disposed on the outside surface of the core 3 may thereby serve as a separating layer 4 for further processing. Alternatively, the core 3 can be produced by the formation or extrusion method in accordance with the invention.

The core 3 is inserted into the first hole 7 of the first hollow block 1, as illustrated in FIG. 1. When the core press block 11 has been punched out without sliding layer 4*a,* an additional separating layer 4 is applied to the resulting core before insertion.

Figure 4:
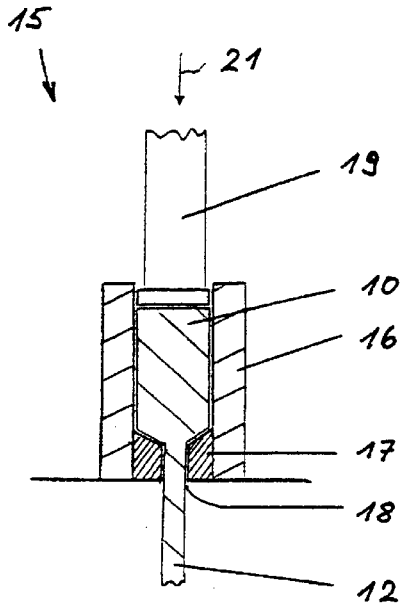
FIG. 4 shows a schematic illustration of a device for direct extrusion.
Figure 5:
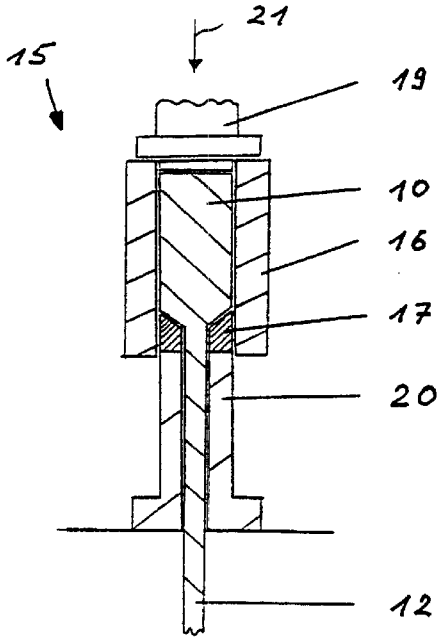
FIG. 5 shows a schematic illustration of a device for indirect extrusion.

Formation by extrusion is illustrated in FIGS. 4 and 5. For extrusion, the composite block 10 of FIG. 1, comprising the first hollow block 1 and the core 3, is heated to approximately 900 to 950° C. and inserted into a heatable block recepticle 16 of a press 15. The temperature depends on the alloys used. The extrusion temperature for other nickel titanium alloys can typically be between approximately 850 and 950° C. To improve uniform flow of the core 3 and the hollow block 1 in a composite block 10 having different hollow block and core materials, these components can be heated separately to different temperatures prior to extrusion, subsequently combined, and then extruded together into a formed composite block 12.

In pressing by direct extrusion (FIG. 4), the die 17 and the block recepticle 16 are stationary. An extrusion die 19 moves downwardly in the direction of the arrow 21 and exerts pressure on the composite block 10 which then moves relative to the block receptacle 16 and is extruded through the opening 18 of the die 17 as a shaped composite block 12.

In a preferred manner, the composite block 10 is fashioned by indirect extrusion (FIG. 5). A die 17 is thereby disposed on an end of a hollow die 20 and moves relative to the block recepticle 16 and the composite block 10 inserted therein due to the pressure of the extrusion die 19, to effect extrusion. It thereby penetrates into the composite block 10 which is extruded through the opening 18 of the die 17 and the hollow die 20 as a formed composite block 12. Indirect extrusion has the advantage over direction extrusion that essentially no differences in flow velocity occur during extrusion between areas of the composite block 10 close to the edge and further inwardly. This effects largely homogeneous material flow and counteracts undesired wall thickness variations in the produced tube. Indirect extrusion is therefore preferred due to the small pressing force required and the improved material flow associated with the lack of friction between the receptacle and the press block.

Figure 6:
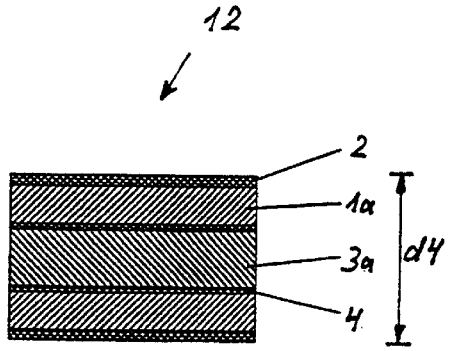
FIG. 6 shows a partial longitudinal section through a formed composite block.

Using direct, indirect or another, e.g. hydrostatic extrusion or another formation method, a first tube is fashioned from the first perforated hollow block 1 as hollow block 1*a* and a reduced core 3*a* is fashioned from the original core 3, both constituting components of the formed composite block 12 (FIG. 6). A comparison between FIG. 1 and FIG. 6 shows that both the composite block diameter d2 and the core diameter d3 are reduced by extrusion. One sees that the pressing ratio was chosen such that the external diameter d4 of the formed composite block 12 essentially corresponds to the core diameter d3. The pressing ratio is approximately 14:1 in this case. Due to the same formation behavior of the core 3 and the first hollow block 1, the pressing ratio creates a first tube la with an external diameter of approximately 30 mm and an internal diameter of approximately 8 mm. The ratio between external and internal diameters is maintained during extrusion.

If these dimensions are already sufficient for subsequent formation operations, the reduced core 3*a* can be removed from the tube 1*a* after one formation step. For removal or loosening of the reduced core 3*a,* the formed composite block 12 is mechanically treated. The reduced core 3*a* is thereby expanded at a temperature below the transition temperature of the core material. With this temperature, the tube 1*a* remains in the austenitic and thus elastic state, while the reduced core 3*a,* in the martensitic range, is plastically formed. Due to the tensile stress, the reduced core 3*a* becomes longer (change of length up to 10%) and thinner and can therefore be removed from the tube 1*a.* If the core 3 comprises a superelastic alloy, expansion preferably occurs by clamping the reduced core 3*a* on one side and the tube 1*a* on the other side. Further possibilities for loosening the reduced core 3*a* in a mechanical manner are, in particular, flex-leveling, rolling and hammering of the composite block 12.

To remove or loosen the reduced core 3*a,* the composite block 12 can also be subjected to a thermal shock treatment. Thereby material or composition differences induce stresses leading to release of the reduced core 3*a* in the tube 1*a* to enable subsequent pulling out of same. When a non-nickel titanium alloy core is used, the composite block 12 can also be chemically treated for removing or loosening the reduced core 3*a.* With a copper chrome alloy core, the composite block is treated e.g. with nitric acid for dissolving or for etching of the reduced core 3*a* without attacking the nickel titanium tube. A combination of mechanical, chemical or thermal methods of removing or loosening the reduced core 3*a* can also be used.

When suitable materials are used for the separating layer 4, the parts can be easily separated, e.g. by simple pulling.

Figure 7:
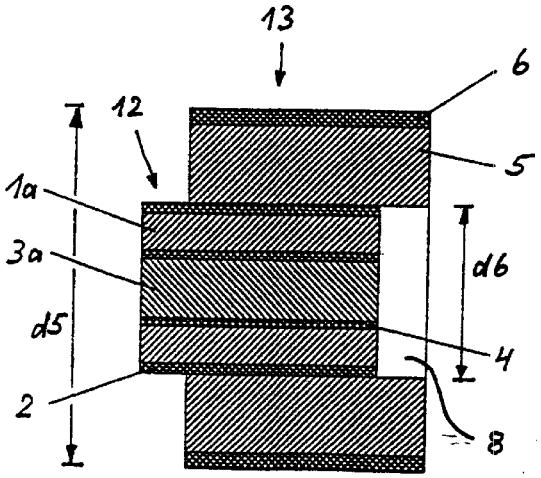
FIG. 7 shows a longitudinal section through a multiple composite block.

To obtain even smaller external and internal diameters for the first tube 1*a,* the composite block 12 can be cut to length before removal of the reduced core 3*a* and inserted into a second hole 8 produced in a second hollow block 5 of a nickel titanium alloy to form the multiple composite block 13, shown in FIG. 7. The sliding layer 2 on the composite block 12 from the first pressing operation can thereby serve as a separating layer. If the composite block 10 was extruded without a sliding layer 2, a separate separating layer is applied to the composite block 12 before insertion into the second hole 8. The outer surface of the second hollow block 5 whose external diameter d5, including sliding layer 6, is approximately 110 mm, is also provided with a sliding layer 6 of copper. The diameter d6 of the second hole 8 corresponds to the diameter d1 of the first hole 7 in the first hollow block 1.

Figure 8:
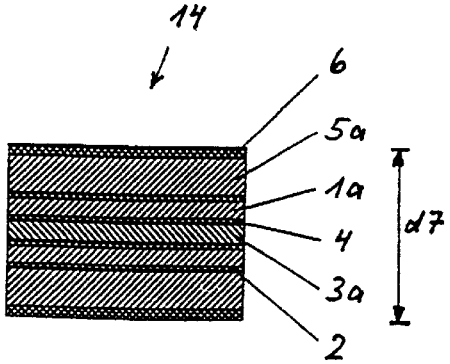
FIG. 8 shows a partial longitudinal section through a formed multiple composite block.

The resulting multiple composite block 13, comprising the second hollow block 5 and the composite block 12 with reduced core 3*a,* is formed e.g. by means of extrusion, to an external diameter d7 which corresponds essentially to the diameter d6 of the inserted composite block 12 (FIG. 8). The diameters of the second hollow block 5 and of the composite block 12 are thereby reduced. The formed multiple composite block 14 comprises a second tube 5*a* formed from the second hollow block 5, the further reduced first tube 1*a* and the further reduced core 3*a.* Since the same geometric pressing ratio is used for extrusion as in the first pressing step, the second tube 5*a* has an external diameter of approximately 30 mm and an internal diameter of approximately 8 mm, whereas the first tube 1*a* has an external diameter of approximately 8 mm and an internal diameter of approximately 2.2 mm.

After formation, the reduced core 3*a* is removed as described above. The concentric tubes 1*a,* 5*a* of the multiple composite block 14, arranged within one another, are separated. The tubes 1*a,* 5*a* thereby produced are available for further formation. The formed core 3*a* can be used as wire or be further processed.

The second formation step can be followed by one or more further formation steps before separating the tubes 1*a,* 5*a* and removal of the reduced core 3*a* of the multiple composite block 14 to further reduce the tube diameters. The reduced core, with one or more inner tubes, can thereby also be removed and replaced by another core, as explained above.

FIGS. 9 to 20 illustrate a method in accordance with the invention for producing thin hollow profiles of nickel titanium alloys, wherein the original material is divided into three zones and the zone spaces are filled with non-metallic powdery materials. Formation is carried out preferably by extrusion, with an extruded pressed product being generated which maintains the zone structure. The powdery material in the zone spaces prevents contact between the individual parts which can be separated, after formation, into tube-shaped hollow profiles with different diameters and a solid profile. FIGS. 9 to 20 show an embodiment comprising a core and two tube-shaped hollow blocks disposed around the core with respective gaps therebetween. Other variants can comprise only one or more than two hollow blocks.

FIGS. 9 to 12 illustrate how a solid cylindrical nickel titanium original material is divided into three zones, comprising the core 3, the first hollow block 1 and the second hollow block 5. Division can preferably be effected by spark erosion.

Figure 9:
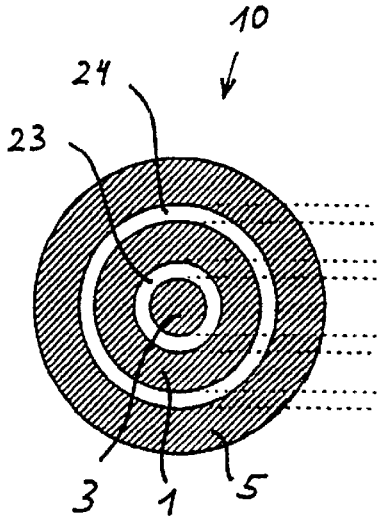
FIG. 9 shows a cross-section of a wire EDM block divided into three zones.
Figure 10:
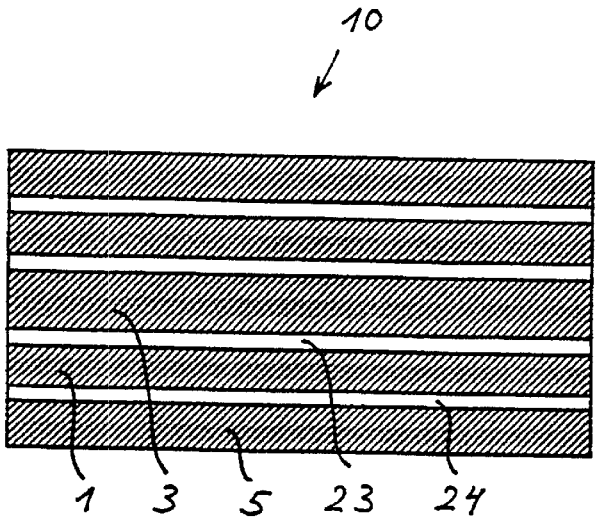
FIG. 10 shows a longitudinal section of FIG. 9.
Figure 11:
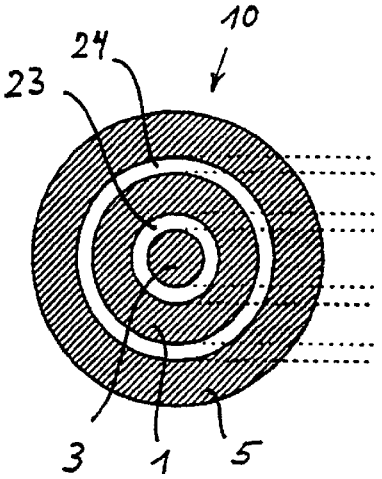
FIG. 11 shows a cross-section of an EDM cavity-sunk block divided into three zones.
Figure 12:
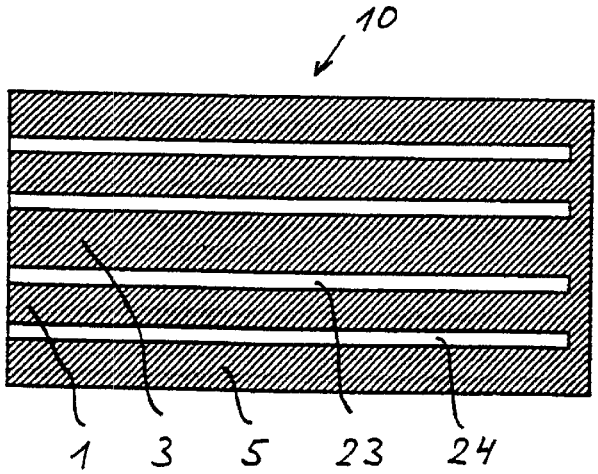
FIG. 12 shows a longitudinal section of FIG. 11.
Figure 13:
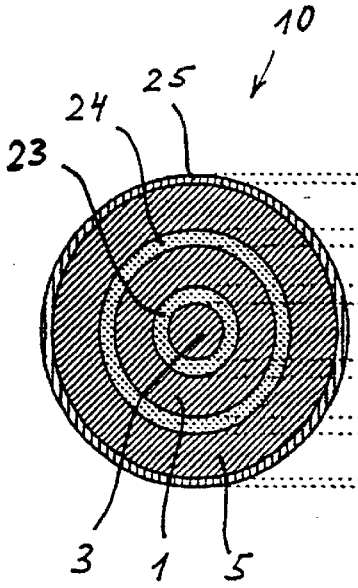
FIG. 13 shows the block prepared for extrusion, in accordance with FIG. 9.
Figure 14:
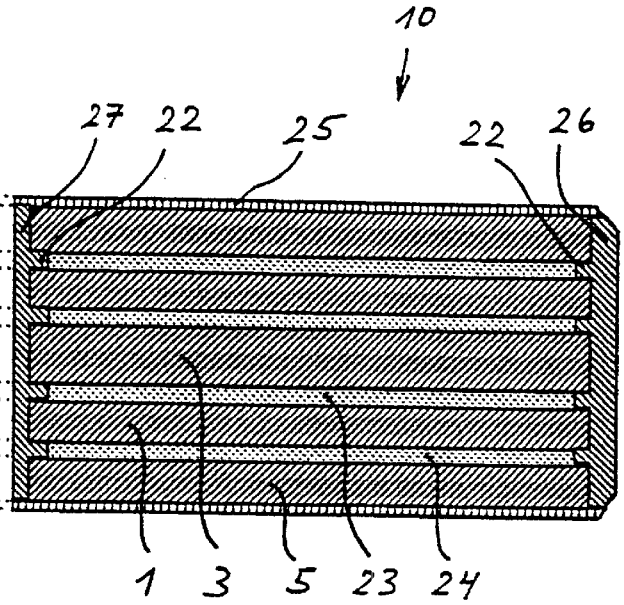
FIG. 14 shows a longitudinal section of FIG. 13.
Figure 15:
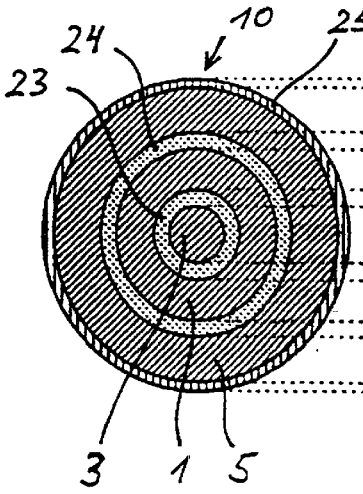
FIG. 15 shows the block prepared for extrusion in accordance with FIG. 11.

In the embodiment in accordance with FIGS. 9 and 10, division is carried out by wire EDM. The original material can thereby be cut about the circumference of the gap along its inner and also outer diameter using a wire which is thinner than the gap width. The wire EDM method has the advantage that little waste material is produced, since a compact recyclable sleeve having the dimensions of the separating gap 23 or 24 is generated. Two different methods are thereby possible. If the erosion wire is inserted along a longitudinal bore into the original material, a compact tube, closed about its circumference, is released out of the separating gap 23 or 24. If, however, the wire is applied radially, the piece separated from the original material forms a sleeve with a longitudinal slit which can also be further utilized.

In cavity sink EDM (FIGS. 11 and 12), the cross-section of the separating gap 23 or 24 is eroded. The electrodes are thin-walled tubes of copper or copper alloy whose diameter corresponds to the diameter of the separating gaps. During erosion, the electrodes can be moved about and/or along their longitudinal axis. In cavity sink EDM, the material in the separating gaps 23, 24 is fine erosion waste. Cavity sink EDM has the advantage, that, when the electrodes are not completely guided through the original material, a bottom remains at one end of the block which stabilizes the arrangement. When the separating gaps 23, 24 are subsequently filled with a material for the separating layer, this bottom advantageously facilitates filling and prevents the filled material from falling out. The bottom is shown at the right-hand side of FIG. 12.

Wire EDM and also cavity sink EDM have the advantage, compared to other methods such as drilling and the like, that little nickel titanium waste is produced, since only the material in the separating gaps 23, 24 or only part of this material is wasted.

After separating the original material into a core 3, a first hollow block 1 and a second hollow block 5, the separating gaps 23, 24 are filled with powder to generate a composite block 10 with three nickel titanium zones and two zone gaps.

FIGS. 13 to 16 show such finished composite blocks 10 which are prepared for pressing. They are surrounded by a sleeve 25 of copper to prevent direct contact between the nickel titanium of the second hollow block 5 and the die during extrusion and associated welding between the nickel titanium and the tool steel. Towards this end, the end faces of the composite blocks 10 are also provided with a disc 26 made from a highly rigid copper alloy.

Figure 16:
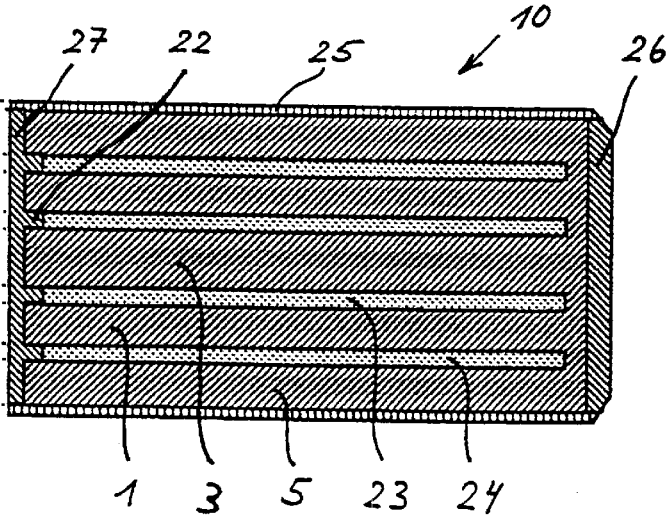
FIG. 16 shows a longitudinal section of FIG. 15.

To prevent escape of the powder located in the separating gaps 23, 24, the block end is closed with a second disc 27 made from a copper alloy having high rigidity. Guiding pieces 22 fill the separating gap 23, 24 or portions thereof proximate the block ends to mechanically fix and stabilize the arrangement. They can be formed e.g. on the second discs 27 (see FIGS. 14 and 16). The disc 26 of FIG. 14 also has guiding pieces 22, since the separating gaps 23, 24 penetrate completely through the material. In FIG. 16, the right-hand block end is stabilized by bridges remaining following cavity sink EDM.

The powder material used for filling the separating gaps 23, 24 preferably consists of hard, temperature-resistant metal oxides such as e.g. aluminium oxide powder which facilitates sliding during the formation process during which the shape of the nickel titanium material is changed, without plastic formation of the oxide particles.

Figure 17:
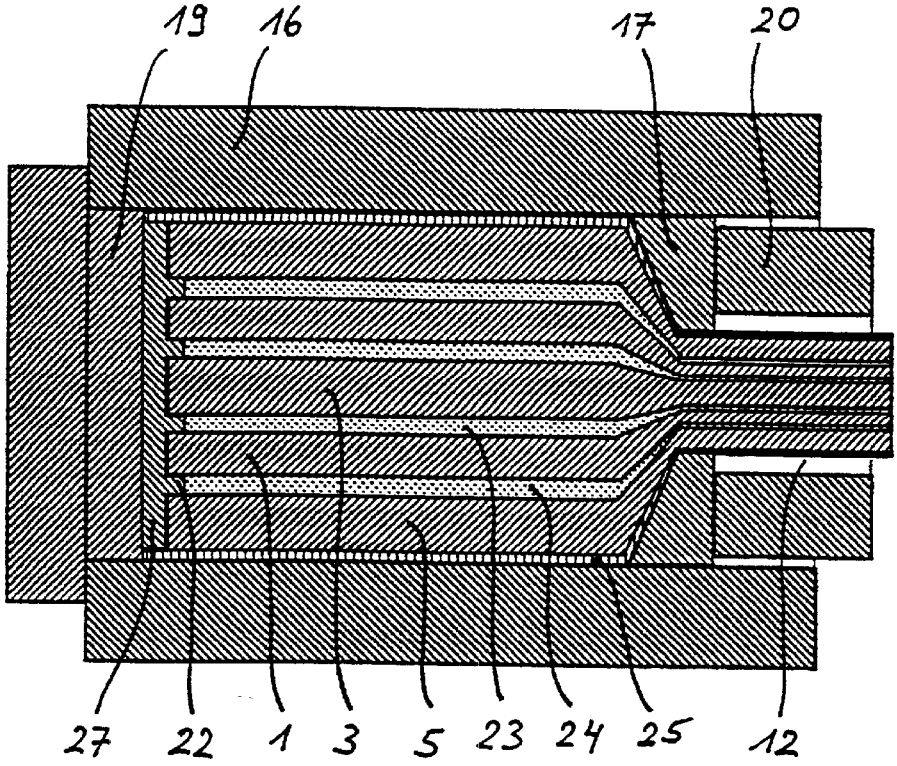
FIG. 17 shows a longitudinal section of the composite block of FIG. 14 or 16 during extrusion.

FIG. 17 illustrates heated formation of the prepared composite block 10 for extrusion into an extruded product. Direct and also indirect extrusion methods are possible. Indirect extrusion is preferred (FIG. 17). The composite block 10 is inserted into the block receptacle 16 and moved by the pressing operation, wherein the block receptacle 16 and the extrusion die 19 move together with the composite block 10 to be pressed in the direction of the extrusion die 17, seated on a hollow die 20, and pressed against the extrusion die 17 for shaping into a formed, extruded product, composite block 12.

Figure 18:
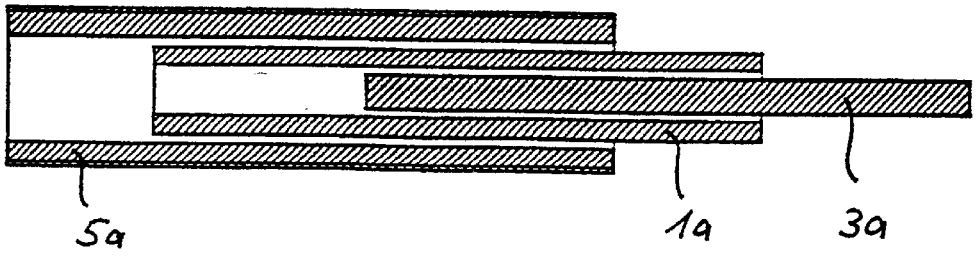
FIG. 18 shows the separating of the formed composite block of FIG. 17.

FIG. 18 shows separation of the individual parts contained in the formed composite block 12 by pulling them out to thereby obtain the desired formation products comprising a reduced core 3*a* of solid round profile, a formed hollow block 1*a* of tubular shape and a formed second tubular hollow block 5*a*. In one single formation process, two or more tubular formed products of different sizes and a solid profile side product are produced. The material waste and the preparation effort are low. A costly preparation step for separating the individual parts can also be omitted. The powder inserted into the separating gaps 23, 24 can usually be re-used.

Figure 19:
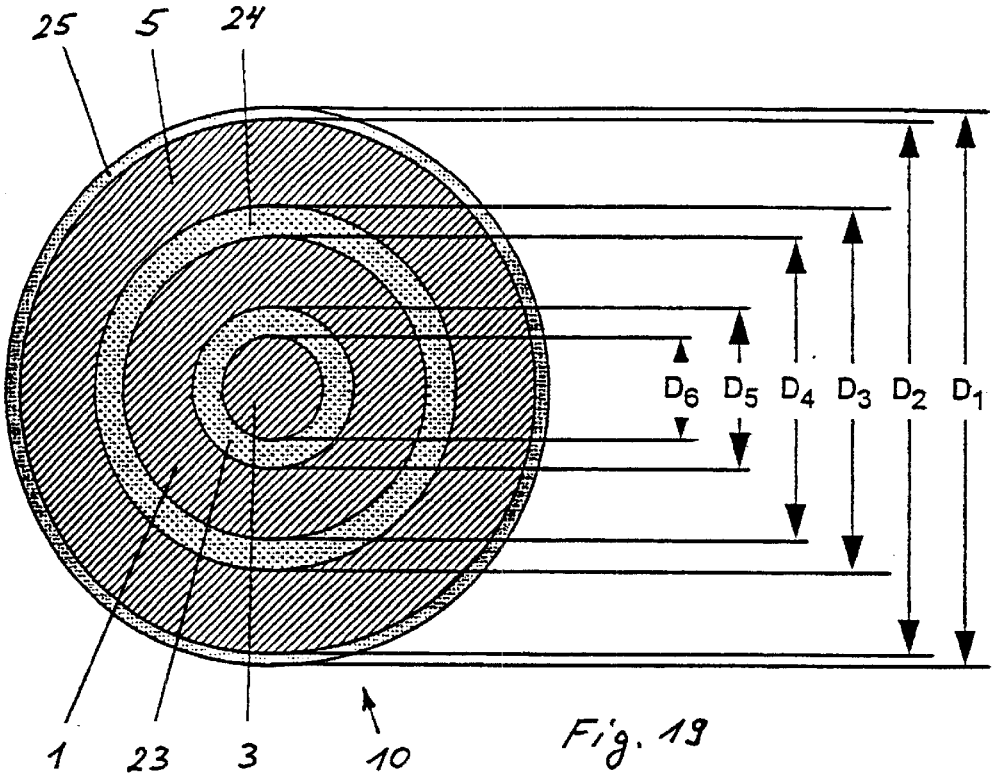
FIG. 19 shows a cross-section in accordance with FIG. 11.
Figure 20:
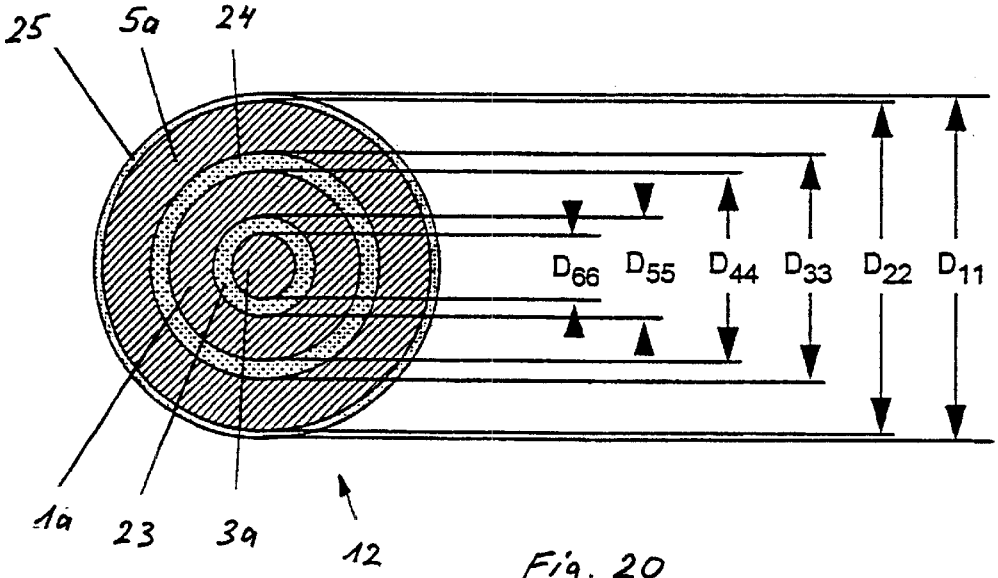
FIG. 20 shows the cross-section of FIG. 19 after formation.

FIGS. 19 and 20 show a numerical example of a method in accordance with the invention according to FIGS. 9 through 18, wherein a nickel titanium press block divided into three zones is separated into three extruded products following heated shaping by extrusion, wherein the diameters and wall thicknesses of the individual parts are reduced. Extrusion of a composite block 10 having a diameter $D_1$ of approximately 110 mm, using a block receptacle having a diameter of 110 mm, and a die having a diameter of approximately 26 mm gives a pressing ratio of approximately 18:1. In other words, the ratio between the cross-sectional area of the composite block 10 to be extruded, which corresponds to the cross-sectional area of the block receptacle, and the cross-sectional area of the composite block 12 formed into an extruded product, which corresponds to the cross-sectional area of the die opening, is 18:1. During extrusion of a nickel titanium press block comprising several zones, the individual zones and zone gaps are also formed with a pressing ratio of 18:1.

The dimensions shown in FIGS. 19 and 20 for the individual zones in the composite block 10 and of the formed composite block 12 are approximately as follows: $D_1$ 110 mm, $D_2$ 108 mm, $D_3$ 89 mm, $D_4$ 76 mm, $D_5$ 63 mm, $D_6$ 51 mm, $D_{11}$ 26 mm, $D_{22}$ 25.5 mm, $D_{33}$ 21 mm, $D_{44}$ 18 mm, $D_{55}$ 15 mm and $D_{66}$ 12 mm. This numerical example does not take into consideration possible further compression of the separating layer powder material contained in the separating gaps 23, 24 during extrusion which could lead to slight deviations in the product dimensions. This effect can be compensated for with a corresponding change in the diameters of the individual zones of the composite block 10.

After separating the formed composite block 12 into individual parts, the following products are produced: the reduced core 3*a* which is a round full profile of diameter $D_{66}$; the formed first hollow block 1*a* which is a tube having an external diameter $D_{44}$ and an internal diameter $D_{55}$; the formed second hollow block 5*a* which is a second tube 5*a* having an external diameter $D_{22}$ and an internal diameter $D_{33}$. The formed composite block 12 is surrounded by an approximately 0.25 mm, thin copper layer (diameter $D_{11}$) when a copper sleeve 25 is used.

List of References

1 first hollow block
1*a* formed hollow block
2 sliding layer on 1
3 core
3*a* reduced core
4 separating layer
4*a* sliding layer on 3
5 second hollow block
5*a* second tube
6 sliding layer on 5
7 first hole
8 second hole
10 composite block
11 core press block
12 formed composite block
13 multiple composite block
14 formed multiple composite block
15 press
16 block receptacle
17 die
18 opening of the die
19 punch
20 hollow die
21 direction of arrow
22 guiding piece
23 separating gap
24 separating gap
25 sleeve
26 disc
27 second disc
d1 diameter of 7
d2 diameter of 1 including 2
d3 diameter of 3 including 4 or 4*a*
d4 diameter of 12
d5 diameter of 5 including 6
d6 diameter of 8
d7 diameter of 14

What is claimed is:

1. Method of producing hollow profiles having small external diameters and/or small wall thickness from a nickel titanium alloy by shaping a composite block, wherein in a first step, a composite block is formed comprising a solid core of nickel titanium alloy, a first hollow block of nickel titanium alloy surrounding the core, and a separating layer disposed between the first hollow block and the core, in a second step, the composite block is shaped by a formation method, and in a third step, the first hollow block shaped into a first hollow profile, and the shaped core are removed from the shaped composite block, characterized in that either the composite block is formed with one or more additional hollow blocks which are placed around the first hollow block and which each comprise a separating layer between neighboring hollow blocks and, in the second step, the composite block comprising several hollow blocks and the core is shaped, or, following the second and before the third step, the shaped first composite block is inserted as a core into an additional hollow block of a nickel titanium alloy, wherein the second composite block formed in this fashion comprises a separating layer between the core and the additional hollow block, and, subsequently, the second composite block is shaped by a formation method, and, subsequently, in the third step, the additional hollow block, shaped into a hollow profile, the additional shaped first composite block and the additional shaped core are removed from the shaped second composite block.

2. Method according to claim 1, characterized in that the composite block is shaped by an extrusion method, wherein the composite block is inserted as a heated press block into a block receptacle of a press and is extruded through the opening of a die via the pressure of an extrusion die.

3. Method according to claim 2, characterized in that the composite block moves relative to the block receptacle during extrusion.

4. Method according to claim 2, characterized in that the die is disposed at a tip of a hollow die and moves relative to the block receptacle and the inserted composite block during extrusion of the composite block.

5. Method according to claim 2, characterized in that the composite block is heated up for extrusion to a temperature between 850 °C. and 950 °C., preferably between 900° C. and 950° C.

6. Method according to claim 1, characterized in that the composite block is formed by warm drawing, cold drawing, rolling, round-hammering or pilger method.

7. Method according to claim 1, characterized in that the composite block is formed by inserting the core into the first hollow block, in particular into a hollow profile, and preferably into a tube.

8. Method according to claim 1, characterized in that the composite block is formed by sliding several hollow blocks, in particular hollow profiles and preferably tubes, into one another.

9. Method according to claim 1, characterized in that a hole is drilled or milled into a block or through a block to produce a hollow block having a hole for insertion of the core.

10. Method according to claim 1, characterized in that the composite block, a hollow block, or the core are formed by cavity sink EDM or wire EDM of a solid nickel titanium block, a nickel titanium hollow block or another nickel titanium workpiece.

11. Method according to claim 1, characterized in that prior to separation of the shaped hollow blocks and the core, the insertion of a resulting shaped composite block into an additional hollow block of a nickel titanium alloy and the shaping of the composite block formed in this fashion are repeated once or a plurality of times.

12. Method according to claim 1, characterized in that in the second step, the composite block is shaped to a diameter which corresponds essentially to the diameter of the core prior to the second step, such that the shaped composite block can be inserted as a core into an additional hollow block having the same core diameter as the first composite block.

13. Method according to claim 1, characterized in that the shaped composite block is mechanically treated, subjected to a thermal shock treatment or chemically treated for removing a hollow profile or the core.

14. Method according to claim 1, characterized in that, prior to formation, a core in a composite block has a diameter between 10 mm and 60 mm, preferably between 20 mm and 40 mm.

15. Method according to claim 1, characterized in that, following a shaping step, a composite block has an external diameter less than 40 mm, preferably less than 25 mm.

16. Method according to claim 1, characterized in that a hollow block and/or the core are made from a nickel titanium alloy having superelastic properties or from a shape memory alloy.

17. Method according to claim 1, characterized in that the core is made from a nickel titanium alloy having a higher martensite-austenite-transition temperature than the alloy of the hollow block.

18. Method according to claim 1, characterized in that the nickel titanium workpiece is treated with a spark erosion method, in particular by means of cavity sink EDM or wire EDM, for removing or separating a core or a hollow profile from a block.

* * * * *

UNITED STATES PATENT AND TRADEMARK OFFICE

CERTIFICATE OF CORRECTION

PATENT NO. : 6,453,536 B1 
DATED : September 24, 2002
INVENTOR(S) : Klaus Muller and Hans Husskern It is certified that error appears in the above-identified patent and that said Letters Patent is hereby corrected as shown below:

Column 12,
Line 64, after "and/or" and before "small" insert -- a --.

Signed and Sealed this

Fifteenth Day of April, 2003

JAMES E. ROGAN
*Director of the United States Patent and Trademark Office*